United States Patent [19]

Widener

[11] 4,256,006

[45] Mar. 17, 1981

[54] MULTI-TONE PERCUSSION INSTRUMENT

[76] Inventor: G. Paul Widener, 5910 San Bernardo, #165, Laredo, Tex. 78041

[21] Appl. No.: 37,540

[22] Filed: May 10, 1979

[51] Int. Cl.[3] ..... G10D 13/02

[52] U.S. Cl. ..... 84/411 R

[58] Field of Search ..... 84/411-420; D17/22

[56] References Cited

U.S. PATENT DOCUMENTS

| | | | |
|---|---|---|---|
| 913,796 | 3/1909 | Wolff | 84/420 |
| 4,111,094 | 9/1978 | Broser | 84/411 R |

OTHER PUBLICATIONS

Thomas, George B., Jr., "Calculus And Analytic Geometry," Addison-Wesley Publishing Company, Inc., Reading, Mass., U.S.A. and London, England, pp. 649-650, 2-1961.

*Primary Examiner*—Lawrence R. Franklin

*Attorney, Agent, or Firm*—Richards, Harris & Medlock

[57] ABSTRACT

A multitone percussion instrument capable of producing a variety of drum tones from a single vellum (2) mounted on a shell portion (1) is described. Tone separation along the expanse of vellum of the drum is effected by providing a rim (3) comprising a compound warp to which the vellum is affixed. In a preferred embodiment, the compound warp comprises a section of a hyperbolic paraboloid defined by straight line boundaries.

7 Claims, 7 Drawing Figures

MULTI-TONE PERCUSSION INSTRUMENT

TECHNICAL FIELD

In one aspect, the present invention relates to a musical percussion instrument capable of producing multiple tones. In another aspect, this invention relates to a drum comprising a vellum, or head, having at least one compound warp so as to be capable of producing several distinct drum tones.

BACKGROUND ART

Most popular music performed today includes, as part of the instrumentation used therein, a variety of tones obtained from sets of drums. Normally, the musician playing the drums will have several separate instruments arranged around him so that he can easily produce a variety of tones by striking the vellum, or head, of drums having various configurations. Examples of these prior art musical instruments include congo type drums, tom-tom drums and floor toms, for example. The variety of tones produced by each different type of drum is dependent upon the taughtness of the drum head over the drum shell, and the configuration of the drum shell itself. Until recently, the various tones produced by different drums were controlled by varying the generally circular diameter of the drum shell and/or the depth or height of the shell within which the sound produced by striking the vellum reverberated. Thus, conventional drum sets usually comprise a multiple number of drums having shells of varying diameter and depth.

It would be very advantageous if a single instrument comprising one single vellum, or head, could be provided which would effectively produce the various tonal qualities heretofore obtainable only from a multiple number of drum instruments. Among the advantages to such an instrument would be convenience of transportation, cost effectiveness, and ease of use. Multiple tone drums have been disclosed in the prior art; however, such prior art devices employed separate vellums mounted on a single shell in order to produce the multiple number of tones. See, for example, U.S. Pat. No. 2,858,724. Furthermore, such devices were not as easy to use as a series of individual drums since the separate vellums were mounted at right angles to one another requiring the musician to apply his talents to drum heads positioned both vertically and horizontally.

DISCLOSURE OF INVENTION

I have discovered that a musical drum instrument can be constructed in a manner so as to provide the musician with an opportunity to produce a multiple number of varying tones from an instrument comprising a single shell with a single head, or vellum, mounted thereon. The multiple tones are provided by forming the drum shell in a manner such that the rim thereof, upon which the vellum is mounted, defines a plane comprising a compound warp. The term "compound warp" as employed herein is defined to include any surface which comprises a warp or twist in a first direction followed by a warp or twist back in the opposite direction, followed by a third twist or warp back in the direction of the first. Thus, for example, if a deformable plane had a first section twisted clockwise, a second section twisted back counterclockwise and a third section twisted clockwise again, the surface would be considered to comprise a compound warp as used herein. A particularly preferred surface comprising a compound warp is a section of a hyperbolic paraboloid surface further defined hereinbelow.

Thus, the novel percussion instrument of the subject invention comprises, in its preferred embodiment, a curvelinear shell portion comprising a first end section of relatively large circular diameter and a second end section of relatively small circular diameter, the two end sections being joined by outer and inner curved walls to form a generally U-shaped shell within which a musician may position himself. As noted above, the rim portion of the shell defines a surface comprising a compound warp such that when a single vellum is mounted and stretched taughtly over the rim of the shell, the surface of the vellum comprises a compound warp. The depth of the shell portion is preferably varied from being fairly deep at the large circumference end of the instrument to fairly shallow at the small circumference end of the instrument. The compound warp of the single vellum provides for tonal separation, thus allowing the single vellum to provide a variety of musical drum tones.

DETAILED DESCRIPTION

Figure 1:
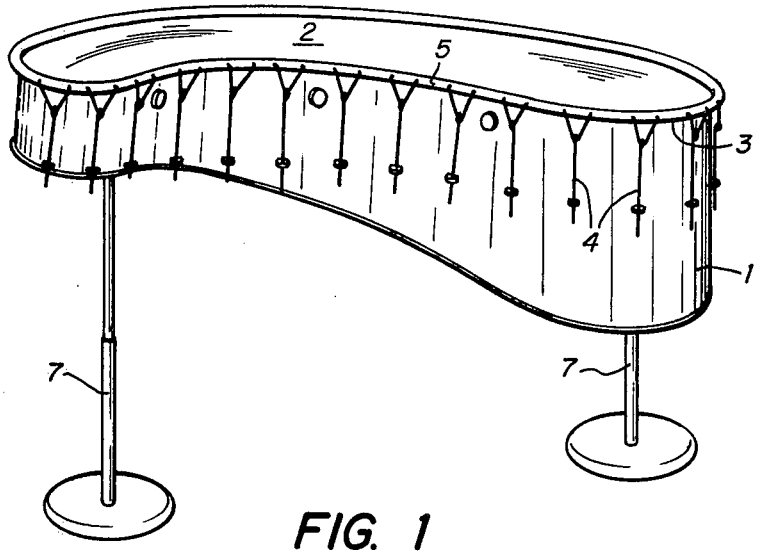
FIG. 1 is a perspective view of one embodiment of the multi-tone drum of the subject invention.

Generally, the multi-tone drum of the subject invention will comprise two basic elements, those being a body or shell portion and a vellum, or striking head, mounted thereon. The shell portion can be manufactured from materials used in the past to manufacture drum shells, such as, for example, wood, sheet metal and plastics. One preferred material for manufacturing the shell of the preferred embodiment of the subject invention is fiber reinforced plastic resin since these materials are well-suited to fabrication of fairly complex shapes such as those required for the preferred embodiment of the invention as further described below.

The striking head, or vellum, is constructed from a thin membrane material usually manufactured from plastic or animal hide. One especially preferred material which has been used in the past on conventional musical drums is a plastic material sold under the trade name "Mylar". Conventional types of vellum clamps can be used to affix the vellum taughtly over the upper edge, or as it is known in the trade, rim, of the shell portion. The vellum clamps can be of an adjustable nature so as to provide for an adjustment of the tension applied to the vellum at various points along the membrane so that the instrument can be tuned as required by the musician.

In addition, it may be desirable to add interior support braces inside the shell in order to add structural support thereto. Various other nonessential components can be added such as snares, for a snare drum effect, or damping means as required by the particular musician. Further, the drum can be mounted on any of a variety of standing means, including adjustable means, so that the height of the instrument from the floor can be adjusted according to the needs of the musician.

Referring to FIGS. 1–5, a preferred embodiment of the drum of the subject invention is depicted. Thus, a curvelinear shell 1 is shown having a vellum 2 mounted and stretched tautly across the upper surface thereof, defined by rim 3. Adjustable vellum clamps 4 serve to hold the vellum in this position via attachment to the wall of the shell 1 and to vellum clamp ring 5, which serves to distribute the tension forces applied by vellum clamp 4 to the vellum 2. Adjustable stand means 7 provide the necessary elevation for the drum surface.

Figure 2:
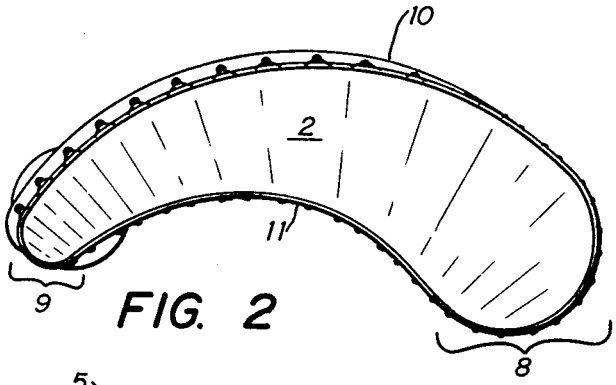
FIG. 2 is a top view of the instrument depicted in FIG. 1.
Figure 3:
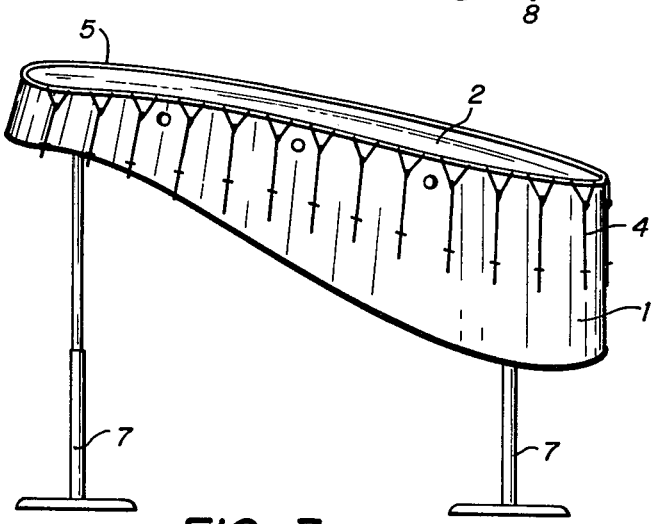
FIG. 3 is a front view of the instrument depicted in FIGS. 1 and 2.
Figure 4:
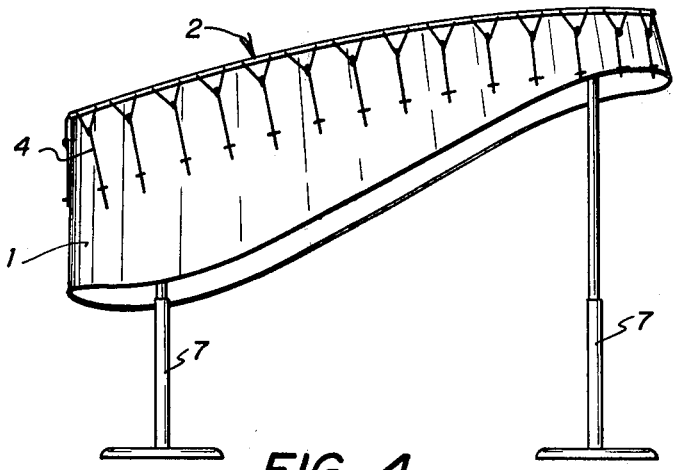
FIG. 4 is a back view of the instrument depicted in FIGS. 1–3.

The preferred embodiment comprises a curvelinear shell having a first end section 8 of relatively large circular diameter, a second end section 9 having a relatively small circular diameter, the first and second end sections being joined by outer curved wall 10 and inner curved wall 11, as best shown in FIG. 2. This general configuration provides for a large expanse of vellum 2 at the first end section 8 so as to obtain deeper tom-tom type tones when this portion of the drum is played. The second end section 9 provides a relatively small expanse of vellum 2 so as to provide higher pitched tones. Intermediate tones are obtained by playing the drum at intermediate portions between the first end section 8 and the second end section 9. As shown best in FIG. 3, the shell depth, that is the length which the shell 1 extends downward from the rim portion 3 thereof, is deepest at the first end section 8, thereby providing a deep resonance chamber for the sounds produced at this end of the instrument. Conversely, at the second end section 9 of the instrument, the depth of the shell 1 is fairly shallow so as to provide higher pitched tones. Intermediate depths are provided along the intermediate portion of the drum shell 1. In a particularly preferred embodiment, the depth of the shell 1 at any point is approximately equal to the width (or diameter) of the portion of the vellum 2 from which it extends downward. Thus, in a particularly preferred embodiment, if the diameter of the first end section 8 is 18 inches, the depth of the shell 1 at that location will also be about 18 inches. If the width across the vellum 2 at a point along the intermediate portion is 10 inches, then the depth of the shell 1 directly below that point of the vellum 2 will also be about 10 inches. With respect to the relationship between the shell 1 and the vellum 2, it is particularly preferred that the shell 1 always be approximately perpendicular to that portion of the vellum 2 to which it is attached. This, of course, will result in a rather complex shape since, as further described below, the rim 3 of the shell (and therefore the vellum 2) lie in a plane defining a compound warp and preferably in a section of a hyperbolic paraboloid having straight line boundaries.

Figure 6:
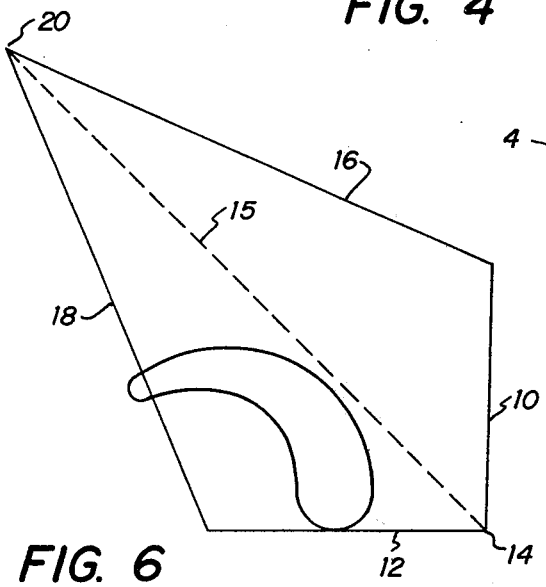
FIG. 6 is a top view of a hyperbolic paraboloid having straight line boundaries which is generally kite shaped from the top view having the shape of a rim (and therefore the vellum) of the preferred embodiment of the drum of the subject invention depicted thereon.
Figure 5:
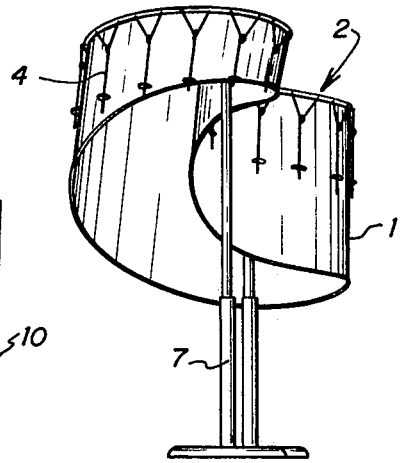
FIG. 5 is an end view of the instrument depicted in FIGS. 1–4.

Referring to FIG. 6, a top view of a hyperbolic paraboloid having straight line boundaries and, from a top view thereof, having a kite shaped configuration is depicted with the shape of a vellum suitable for the preferred embodiment of the present invention shown thereon. The four-sided straight line boundary hyperbolic paraboloid show in FIG. 6 is composed of four sides. Sides 10 and 12 join at point 14 and are of equal length. Similarly, sides 16 and 18, joined at point 20, are of equal length and are approximately twice a long as sides 10 and 12. The saddle or peak of the curved surface is depicted by dotted line 15.

Figure 7:
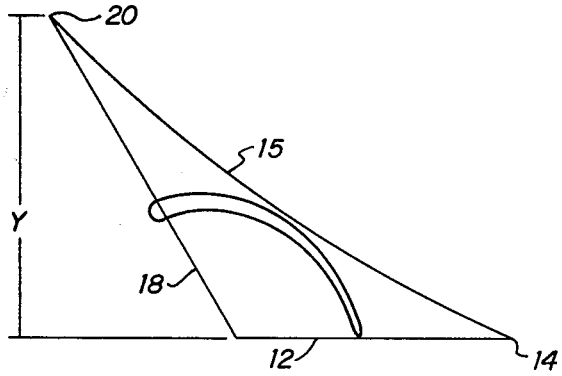
FIG. 7 is a front view of the hyperbolic paraboloid of FIG. 6.

FIG. 7 is a front view of the hyperbolic paraboloid depicted in FIG. 6, showing sides 12 and 18 and points 14 and 20. The third "line" depicted in FIG. 7 is actually not a boundary but rather the saddle 15, or peak, of the curved surface. The distance "y" depicted in FIG. 7 represents the difference in height between the points 14 and 20. This distance "y" determines the extent of curvature of the surface. The optimal amount of curvature for producing a suitable vellum surface having the compound warp discussed above can be defined as a ratio of the distance "y" to the length of side 12 (or 10), for example. The best surfaces for the purpose of the present invention have been determined to be those in which the distance "y" is from about 1.4 to about 0.5 times the length of side 12 (or 10 which is equal to 12). Surfaces wherein distance "y" is less than 0.5 times the length of side 12 are generally too flat to provide a compound warp having good tone separation qualities while distances of "y" which are greater than 1.4 times the length of side 12 cause problems in attempting to tune the instrument since the amount of warp becomes exaggerated.

The most difficult fabrication problem for producing the drums of the subject invention is manufacturing a shell portion having a curvelinear rim which will define a compound warp so that the vellum, or head, attached thereto will also have that characteristic. One method of fabrication which has been successfully employed is to construct a web in the shape of a hyperbolic paraboloid surface as depicted in FIGS. 6 and 7. This can be done by using rigid support members to define boundary lines 10, 12, 16, and 18 and then using strands of wire or rope to complete a webbed surface. This can be accomplished because of the relatively unique ability of a hyperbolic paraboloid surface having straight line boundaries to be constructed from straight lines only. Once the webbed hyperbolic paraboloid surface has been constructed, a shell portion for the drum, or a mold from which the shell portion can be produced, can be constructed by hanging vertical sectioned pieces from the web so that the top surfaces thereof lie in the plane of the hyperbolic paraboloid surface and the sections form an enclosed curvelinear shape, such as, for example, the desired curvelinear shell shape described hereinabove.

The above method can be employed to fabricate a wooden mold from which fiber reinforced plastic drum shell portions can be produced. After trimming excess plastic, applying a decorative outer covering on the shell and adding interior bracing means, the shell portion thus produced can be employed along with a vellum of "Mylar" plastic and vellum clamp ring, and clamps, to produce the drum depicted in FIGS. 1–5.

While the subject invention has been described in relation to the preferred embodiments thereof, various adaptations and modifications will now become apparent to those skilled in the art. All such modifications and adaptations which fall within the scope of the appended claims are intended to be covered thereby.

I claim:

1. A drum for producing a multiple number of resonant and musical tones comprising:

a flexible membrane vellum forming the vibrating head portion of the drum, said vellum being mounted on a shell rim constructed such that the surface of said vellum comprises a compound warp when affixed thereto.

2. The drum of claim 1 wherein said compound warp is achieved by forming the vellum in the shape of a section of a hyperbolic paraboloid having straight line boundaries.

3. The drum of claim 1 wherein said shell comprises a first end section of relatively large circular diameter, a second end section of relatively small circular diameter, said first and second sections being joined by outer and inner curved wall portions.

4. A multi-tone percussion instrument comprising:

(a) a curvelinear shell portion comprising a first end section of relatively large circular diameter and a second end portion of relatively small circular diameter, said first and second end portions being joined by an outer curved wall and an inner curved wall and with the rim of said shell lying in a plane defining a compound warp; and (b) a vellum means formed from a continuous membrane and stretched tightly over the rim of said shell so that the surface of said vellum comprises a compound warp.

5. The multi-tone percussion instrument of claim 4 wherein said rim of said shell lies in a section of hyperbolic paraboloid surface defined by straight line boundaries.

6. The multi-tone percussion instrument of claim 5 wherein the depth of said shell portion along the curvelinear rim thereof is substantially equal to the width of the vellum at the point from which it extends downward.

7. A drum for producing a variety of resonant tones comprising:

a membrane forming the head portion, said membrane being a section of a hyperbolic paraboloid surface defined by straight line boundaries so as to comprise a compound warp and a shell wall portion of substantially rigid material defining a resonance cavity beneath said membrane, said shell wall extending at substantially right angles from the membrane surface at all points along said surface and having a depth approximately equal to the width of said membrane at said points.

* * * * *